US007929003B2

(12) United States Patent
Tsuchida et al.

(10) Patent No.: US 7,929,003 B2
(45) Date of Patent: Apr. 19, 2011

(54) THERMAL PRINTER UNIT

(75) Inventors: Kengo Tsuchida, Izunokuni (JP); Toshiyuki Tamura, Mishima (JP); Yozo Kobayashi, Fuji (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 681 days.

(21) Appl. No.: 11/975,337

(22) Filed: Oct. 18, 2007

(65) Prior Publication Data

US 2008/0094463 A1 Apr. 24, 2008

(30) Foreign Application Priority Data

Oct. 20, 2006 (JP) ..... 2006-286976
Aug. 7, 2007 (JP) ..... 2007-205858

(51) Int. Cl.
*B41J 25/304* (2006.01)
*B41J 2/335* (2006.01)

(52) U.S. Cl. ..... 347/197

(58) Field of Classification Search ..... None
See application file for complete search history.

(56) References Cited

U.S. PATENT DOCUMENTS 5,266,966 A 11/1993 Fushimi et al.
6,409,306 B1 6/2002 Shiida
2003/0184640 A1 10/2003 Sasaki
2005/0063752 A1 3/2005 Sawai
2005/0068405 A1* 3/2005 Ito ..... 347/197

FOREIGN PATENT DOCUMENTS

EP 0 447 162 A1 3/1991
EP 0 822 092 A1 7/1997
JP 2762045 6/1998

OTHER PUBLICATIONS

Communication from European Patent Office re: related application.

* cited by examiner

*Primary Examiner* — Stephen D Meier
*Assistant Examiner* — Alexander C Witkowski
(74) *Attorney, Agent, or Firm* — Patterson & Sheridan, LLP

(57) ABSTRACT

A thermal printer unit according to the invention includes a thermal head, a platen roller which is disposed while facing the thermal head, a support member which fixes the thermal head while thermal transfer ribbon and receptor paper are pressurized and nipped between the thermal head and the platen roller, a conveyance mechanism which conveys the thermal transfer ribbon and the receptor paper using the thermal head and the platen roller, an engaging groove which prevents the thermal head from moving in a paper conveyance direction by the support member, and a retaining portion which prevents the thermal head from moving in a rotating direction, the movement of the thermal head in the rotating direction being generated according to rotation of the platen roller.

12 Claims, 8 Drawing Sheets

THERMAL PRINTER UNIT

CROSS-REFERENCE TO RELATED APPLICATIONS

This application is based upon and claims the benefit of priority from prior Japanese Patent Application No. 2006-286976, filed Oct. 20, 2006; and No. 2007-205858, filed Aug. 7, 2007, the entire contents of both of which are incorporated herein by reference.

BACKGROUND OF THE INVENTION

1. Field of the Invention

The present invention relates to a thermal printer unit used in POS, ECR, barcode printing, a measuring instrument and the like, and particularly to a technology which can improve print quality.

2. Description of the Related Art

The thermal printer unit is a mechanism constituting a main part of a thermal printer. As is well known, in the thermal printer unit, a positional relationship between a thermal head and a platen roller has a large influence on the print quality. Therefore, the positional relationship between a thermal head and a platen roller is very important, and thus an adjusting mechanism or a mechanism, which obtains a proper relationship even if the adjustment is not performed, is generally provided in the thermal printer unit.

However, when receptor paper (paper) is conveyed by the platen roller, disadvantageously a position of the thermal head moves in a paper conveyance direction with respect to the platen roller. Therefore, there is known a technique of preventing the thermal head from moving in the paper conveyance direction (for example, see Japanese Patent No. 2762045). In the technique, a part of a member to which the thermal head is attached engages a shaft of the platen roller to prevent the thermal head from moving in the paper conveyance direction.

There are following problems in the thermal head movement preventing method disclosed in Japanese Patent No. 2762045. As shown in FIG. 14, a force F1 is applied to a thermal head T by a force F2 in a rotating direction, when thermal recording paper or receptor paper W is fed in a horizontal direction while the thermal recording paper or thermal transfer ribbon and the receptor paper W are pressurized and nipped between the thermal head T and a vertex of the platen roller. However, in order to obtain the high print quality, sometimes the thermal recording paper or the thermal transfer ribbon and the receptor paper are pressurized and nipped at a position where the thermal head T and the platen roller are located away from the vertex of the platen roller. A force F3 in the rotating direction is applied to the thermal head T when the thermal recording paper or the receptor paper W is fed from below as shown in FIG. 14. Therefore, the thermal head T moves in the rotating direction to change a relative position between the thermal head T and the platen roller E, which possibly results in a decrease in image quality. Furthermore, there has been the following problem in the thermal head movement preventing method. That is, the force F3 in the rotating direction which is applied to the thermal head from the receptor paper depends on a thickness and stiffness of the paper, when the sheets of receptor paper are differ from each other in type such as a tag (for example, thickness of 160 μm and stiffness of 78 mm) and a label (thickness of 150 μm and stiffness of 39 mm). Therefore, an amount of change in relative position initially set between the thermal head T and the platen roller E varies among the sheets of receptor paper having the different thickness and stiffness. When the printing is performed to the thermal recording paper or the receptor paper, in order to keep the optimum relative position between the thermal head T and the platen roller, it is necessary that position be adjusted by a position adjusting mechanism such that the relative position becomes the optimum between the thermal head T and the platen roller E in consideration of the amount of change in the relative position. It is also necessary that position be set again in each type of the thermal recording paper or receptor paper.

Additionally, sometimes a driving portion of the platen roller is located only on one of sides, or sometimes a distortion phenomenon is generated on both sides of the thermal head due to a driving delay or a pressurizing balance.

BRIEF SUMMARY OF THE INVENTION

In view of the foregoing, an object of the invention is to provide a thermal printer unit which can perform the printing with high quality irrespective of the thickness and stiffness of the receptor paper.

In order to solve the problem, a thermal printer unit according to the invention is configured as follows.

A first aspect of the invention provides a thermal printer unit comprising: a thermal head; a platen roller which is disposed while facing the thermal head; fixing means for fixing the thermal head while nipping thermal recording paper or thermal transfer ribbon and receptor paper between the thermal head and the platen roller; thermal head movement preventing means which is provided in the fixing means to prevent the thermal head from moving in a paper conveyance direction; and thermal head rotation preventing means which is provided in the fixing means to prevent the thermal head from moving in a rotating direction, the movement of the thermal head in the rotating direction being generated according to rotation of the platen roller.

A second aspect of the invention provides a thermal printer unit comprising: a thermal head; a platen roller which is disposed while facing the thermal head; fixing means for fixing the thermal head while thermal recording paper or thermal transfer ribbon and receptor paper are pressurized and nipped between the thermal head and the platen roller; thermal head movement preventing means for preventing the thermal head from moving in a paper conveyance direction by the fixing means; and thermal head vertical movement preventing means for preventing the thermal head from fluctuating in a direction perpendicular to the paper conveyance direction, the fluctuation of the thermal head in the direction perpendicular to the paper conveyance direction being generated according to rotation of the platen roller.

A third aspect of the invention provides a thermal printer unit comprising a thermal head; a platen roller which is disposed while facing the thermal head; fixing means for fixing the thermal head while thermal recording paper or thermal transfer ribbon and receptor paper are pressurized and nipped between the thermal head and the platen roller; thermal head movement preventing means for preventing the thermal head from moving in a paper conveyance direction by the fixing means; thermal head rotation preventing means for preventing the thermal head from moving in a rotating direction, the rotation of the thermal head being generated according to rotation of the platen roller; and torsion preventing means for preventing torsion of the thermal head, the torsion of the thermal head being generated by providing a driving portion of the platen roller on one of sides.

According to the invention, the printing can be performed with high quality irrespective of the thickness and stiffness of the receptor paper.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
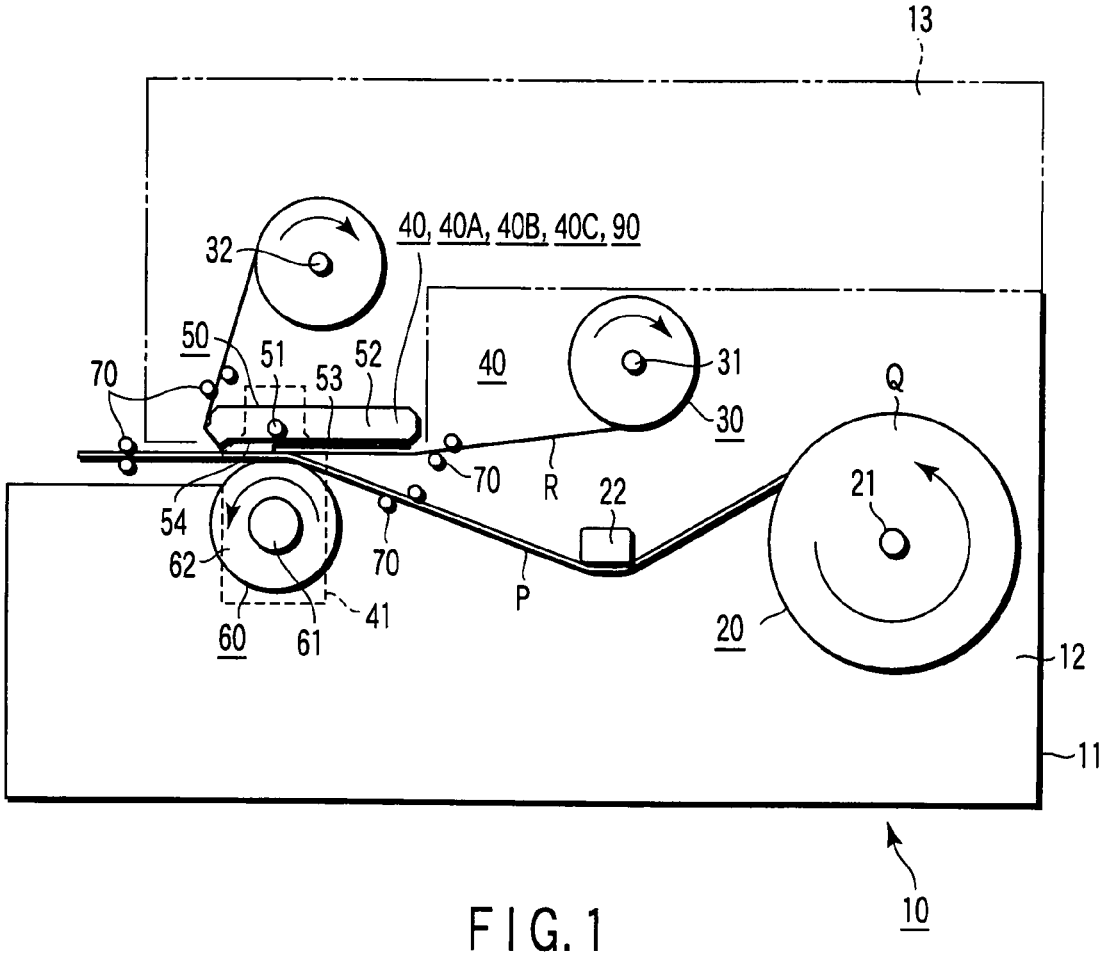
FIG. 1 is a longitudinal sectional view schematically showing a thermal printer into which a thermal printer unit according to a first embodiment of the invention is incorporated.
Figure 2:
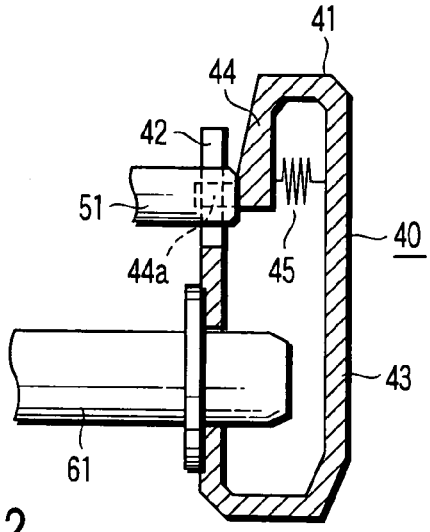
FIG. 2 is a sectional view showing a main part of the thermal printer unit taken along a line X-X of FIG. 3A and viewed in an arrow direction.
Figure 3A:
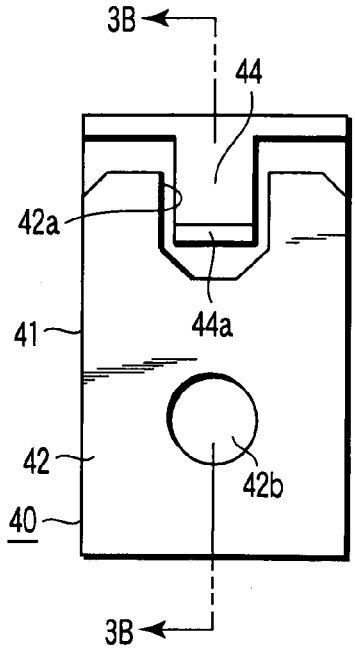
FIG. 3A is a front view showing a support member incorporated into the thermal printer unit.
Figure 3B:
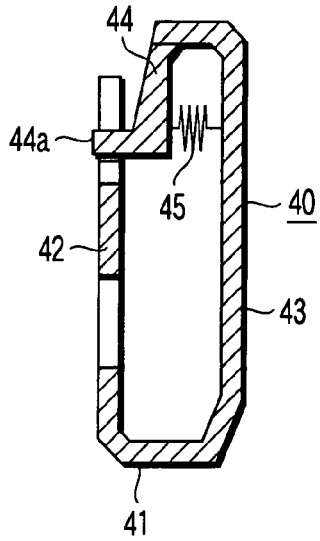
FIG. 3B is a sectional view showing the support member taken along the line X-X of FIG. 3A and viewed in an arrow direction.
Figure 4:
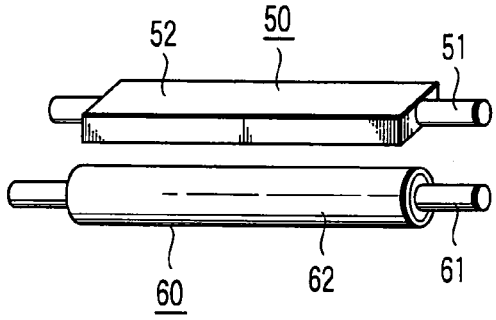
FIG. 4 is a perspective view showing a thermal printer head portion and a platen roller portion which are incorporated into the thermal printer unit.
Figure 5A:
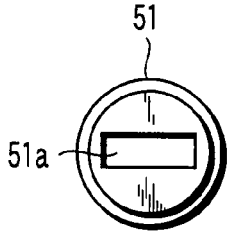
FIG. 5A is a side view showing a main part of a head attaching shaft incorporated into the thermal printer head portion.
Figure 5B:
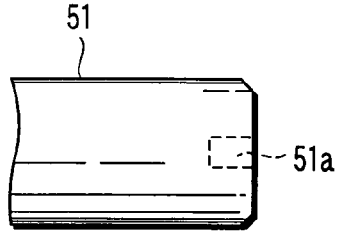
FIG. 5B is a front view showing a main part of the head attaching shaft.

FIG. 1 is a longitudinal sectional view schematically showing a thermal printer 10 into which a thermal printer unit 40 according to a first embodiment of the invention is incorporated, FIG. 2 is a sectional view showing a main part of the thermal printer unit 40, FIG. 3A is a front view showing a support member 41 incorporated into the thermal printer unit 40, FIG. 3B is a sectional view showing the support member 41 taken along the line X-X of FIG. 3A and viewed in an arrow direction, FIG. 4 is a perspective view showing a thermal printer head portion 50 and a platen roller portion 60 which are incorporated into the thermal printer unit 40, FIG. 5A is a side view showing a main part of a head attaching shaft 51 incorporated into the thermal printer head portion 50, and FIG. 5B is a front view showing a main part of the head attaching shaft 51. In FIG. 1, the letter P designates a receptor paper, the letter Q designates a receptor paper roller, and the letter R designates a ribbon.

The thermal printer 10 includes a chassis 11, a chassis body 12 which accommodates mechanisms, and a cover 13 which is provided while freely opened and closed with respect to the chassis body 12.

A receptor paper feed portion 20, a ribbon feed mechanism 30, a conveyance mechanism 70, and the thermal printer unit 40 are accommodated in the chassis 11. The receptor paper feed portion 20 rotatably supports the receptor paper roller Q about which the receptor paper P is entrained, and feeds the receptor paper P. The ribbon feed mechanism 30 feeds and winds the ribbon R. The conveyance mechanism 70 conveys the receptor paper P and the ribbon R. The thermal printer unit 40 thermally transfers the fed ribbon R to the receptor paper P.

The receptor paper feed portion 20 includes a roller retaining portion 21 and a receptor paper guide member 22 which retain and deliver the receptor paper roller Q.

The ribbon feed mechanism 30 includes a feed roller 31 which feeds the ribbon R and a winding roller 32 which winds the ribbon R. The ribbon feed mechanism 30 has a function of feeding the ribbon R to the thermal printer unit 40 with a proper tension while adjusting circumferential speeds of the feed roller 31 and winding roller 32.

The thermal printer unit 40 includes a pair of support members 41, a thermal head portion 50, and a platen roller portion 60. The pair of support members 41 supports a head attaching shaft 51 and a platen roller shaft 61 described later. The platen roller portion 60 is disposed while facing the thermal head portion 50.

As shown in FIGS. 2, 3A, and 3B, the support member 41 includes a support plate 42, a rear-side support plate 43, and a retaining portion 44. The support plate 42 has an engaging groove (thermal head movement preventing means) 42*a* which engages the head attaching shaft (thermal head journaling member) 51 and an insertion hole 42*b* into which the platen roller shaft 61 is inserted. The rear-side support plate 43 is integral with the support plate 42 while parallel to the support plate 42. The retaining portion 44 is provided in an upper portion of the rear-side support plate 43, and can be inserted into and detached from the insertion hole 42*b*. A compression spring 45 is attached between the retaining portion 44 and the rear-side support plate 43 to bias the retaining portion 44 toward the side of the head attaching shaft 51. A front end (latching portion) 44*a* of the retaining portion 44 is formed in a rectangular shape in section.

The thermal head portion 50 includes the head attaching shaft 51, a head attaching bracket 52 attached to the head attaching shaft 51, a head 53 attached to the head attaching bracket 52, and a heating element 54 provided at the head 53. Accordingly, the head 53 is journaled in the head attaching shaft 51. The head attaching shaft 51, the head attaching bracket 52 attached to the head attaching shaft 51, and the pair of support members 41 which supports the head attaching shaft 51 and platen roller shaft 61 constitute the fixing means for fixing the thermal head.

As shown in FIGS. 5A and 5B, a rectangular kerf hole (engaging portion) 51*a* is made in the head attaching shaft 51, and the kerf hole 51*a* is parallel to an axial plane including a rotating axis of the head attaching shaft 51. The above-described front end 44*a* of the retaining portion 44 can be fitted in the kerf hole 51*a*. The rectangular kerf hole 51*a* which is made in an axial direction of the head attaching shaft 51, the support plate 42 having the insertion hole 42*b* into which the platen roller shaft 61 is inserted, the engaging groove 42*a* which is made above the insertion hole 42*b* of the support plate 42 to engage the head attaching shaft 51, and the retaining portion 44 which is inserted into the kerf hole 51*a* of the head attaching shaft 51 engaged with the engaging groove 42*a* constitute the thermal head rotation preventing means, the thermal head movement preventing means, and the thermal head vertical movement preventing means.

That is, when the front end 44*a* of the retaining portion 44 is inserted into and engaged with the kerf hole 51*a* of the head attaching shaft 51, the kerf hole 51*a* constrains the front end 44*a* in the vertical and horizontal directions of FIG. 5A. Because both the front end 44*a* and the kerf hole 51*a* are formed in the rectangular shapes, the head attaching shaft 51 is latched in the rotating direction, and the rotation of the head 53 is regulated through the head attaching shaft 51. At the same time, the head attaching shaft 51 is also latched in the horizontal direction of FIG. 5A, and the movement of the head 53 in the paper conveyance direction is regulated through the head attaching shaft 51. The head attaching shaft 51 is also latched in the vertical direction of FIG. 5A, and the movement of the head 53 is regulated through the head attaching shaft 51.

The platen roller portion 60 includes the platen roller shaft 61 and a platen roller 62 attached to the platen roller shaft 61.

A relative position between the front end 44*a* of the retaining portion 44 which is inserted so as to be fitted in the kerf hole 51*a* of the head attaching shaft 51 and the insertion hole 42*b* of the support member 41 into which the platen roller shaft 61 is inserted, is set such that a relative position between the head 53 and the platen roller portion becomes optimum. That is, an abutting position and an angle are optimally determined between the head 53 and the platen roller 62.

For example, in FIG. 1, a spring mechanism (not shown) is provided above the head attaching bracket 52, and the head attaching bracket 52 is pressurized using a repulsive force of the spring. Therefore, the thermal recording paper or the thermal transfer ribbon and receptor paper nipped between the thermal head 53 and the platen roller 60 by the fixing means is pressurized in the direction of the platen roller 60.

The thermal printer unit 40 is assembled as follows. A bearing is attached into the insertion hole 42*b* in the support member 41, and the platen roller shaft 61 is inserted therein. Then, the retaining portion 44 is pressed toward the right side of FIG. 2 and detached from the insertion hole 42*b*, and the head attaching shaft 51 is inserted into the engaging groove 42*a* of the support member 41. At this point, the head attaching shaft 51 is inserted into the engaging groove 42*a* such that the front end 44*a* of the retaining portion 44 is fitted in the kerf hole 51*a* of the head attaching shaft 51. Then, the retaining portion 44 is retained while inserted into the insertion hole 42*b* by the compression spring 45 biasing the retaining portion 44 toward the side of the head attaching shaft 51.

The printing is performed as follows in the thermal printer 10 assembled in the above-described manner. When a print command is inputted from the outside, the platen roller 60 is driven by a drive motor (not shown), and the receptor paper P is fed to the conveyance mechanism 70. The conveyance mechanism 70 feeds the receptor paper P and the ribbon R to the thermal printer unit 40. In the thermal printer unit 40, the receptor paper P and the ribbon R are nipped between the head 53 and the platen roller 62, and the heating element 54 generates heat to perform the printing to the receptor paper P.

Figure 14:
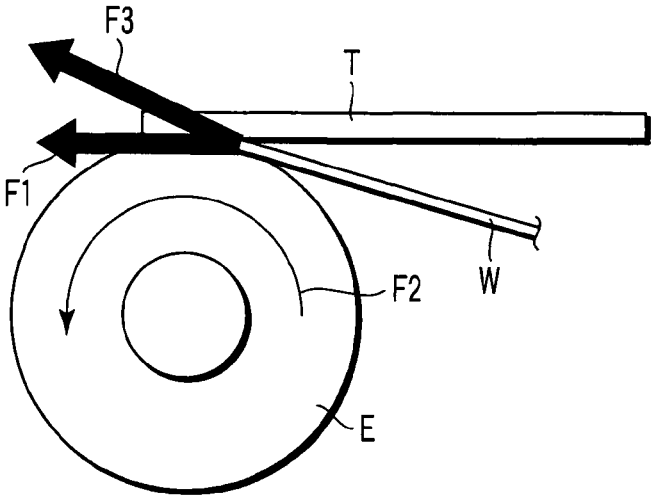
FIG. 14 is an explanatory view showing a problem of the thermal printer unit.

In the printing, when the receptor paper P nipped along with the ribbon R between head 53 and the platen roller 62 is conveyed by the rotation of the platen roller 62, a force F3 shown in FIG. 14 is applied to the head 53 by the stiffness of the receptor paper P, which possibly causes the head 53 to rotate about the head attaching shaft 51. However, the thermal head rotation preventing means prevents the head attaching shaft 51 from moving in the rotating direction. Additionally, the thermal head movement preventing means prevents the head attaching shaft 51 from moving in the receptor paper conveyance direction. Furthermore, the thermal head vertical movement preventing means prevents the head attaching shaft 51 from moving the direction perpendicular to the platen roller 62. Therefore, the relative position is kept between the head 53 and the platen roller portion, and the abutting position, angle and pressure are not changed between the head 53 and the platen roller 62. This enables a high-quality image to be obtained in the printing.

As described above, according to the thermal printer 10 of the first embodiment, when the printing is performed to the receptor paper P in the thermal printer unit 40, a high-quality image can be obtained irrespective of the thickness and stiffness of the receptor paper P.

Figure 6:
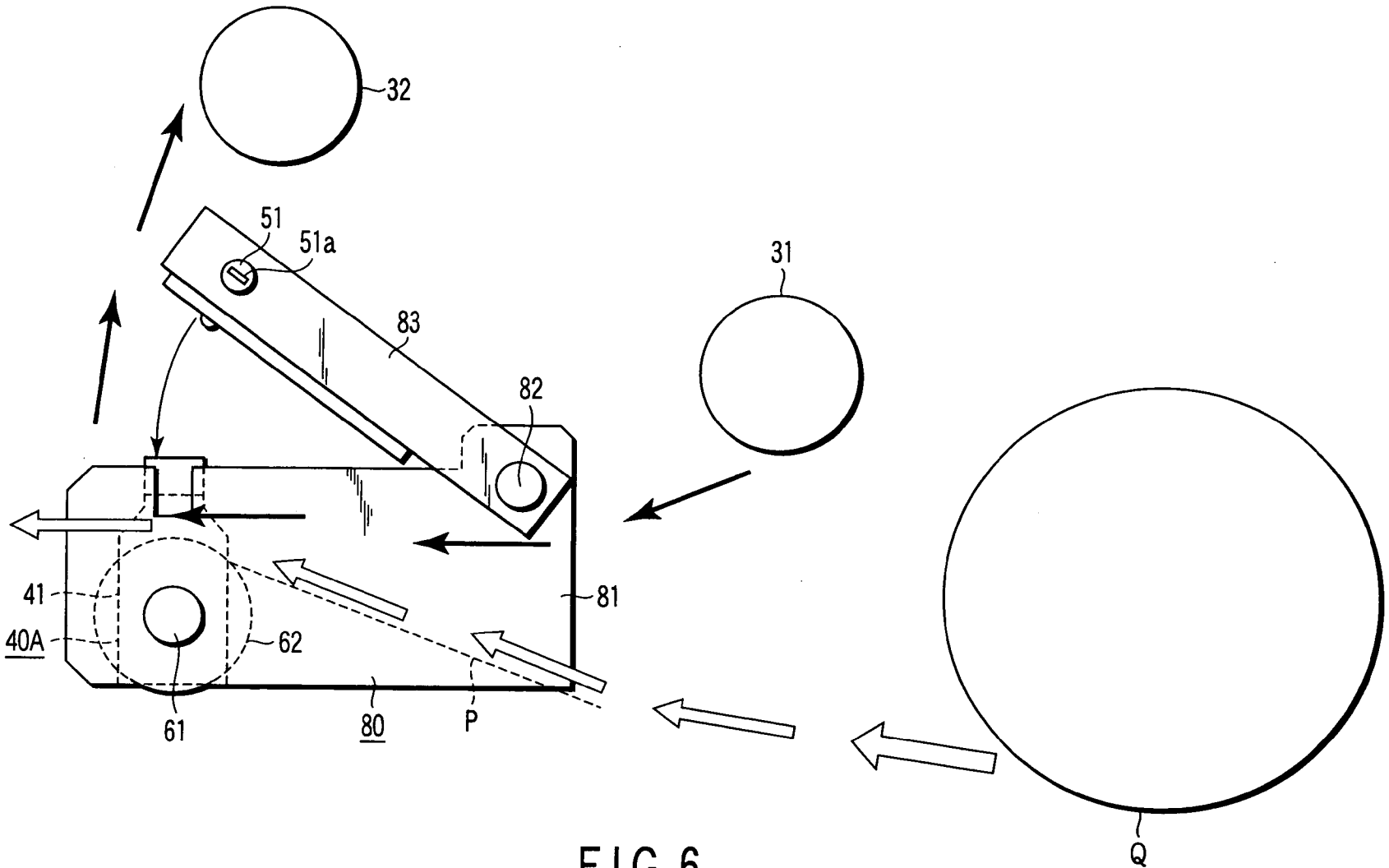
FIG. 6 is an explanatory view showing a modification of the thermal printer unit.

FIG. 6 is a side view schematically showing a thermal printer unit 40A which is a modification of the thermal printer unit 40. In FIG. 6, the same functional portions as those of FIG. 1 are designated by the same numbers, and the detailed description thereof will be omitted.

The thermal printer unit 40A includes a support and fixing member 80. The support and fixing member 80 includes a body portion 81 and a cover portion 83. The body portion 81 retains the support member 41. The cover portion 83 is provided so as to be opened and closed about a hinge 82 with respect to the body portion 81, and supports the thermal head portion 50. That is, the support member 41 supporting the platen roller 62 and the thermal head portion 50 supporting the head 53 are coupled by the common support and fixing member 80.

In a thermal printer 10A having the above-described configuration, because the thermal printer unit 40A includes the support and fixing member 80, a mechanical tolerance and an allowance error are decreased in assembly, so that the positional relationship between the head 53 and the platen roller 62 can be restricted within a predetermined range. This enables a high-quality image to be obtained in the printing.

Figure 7:
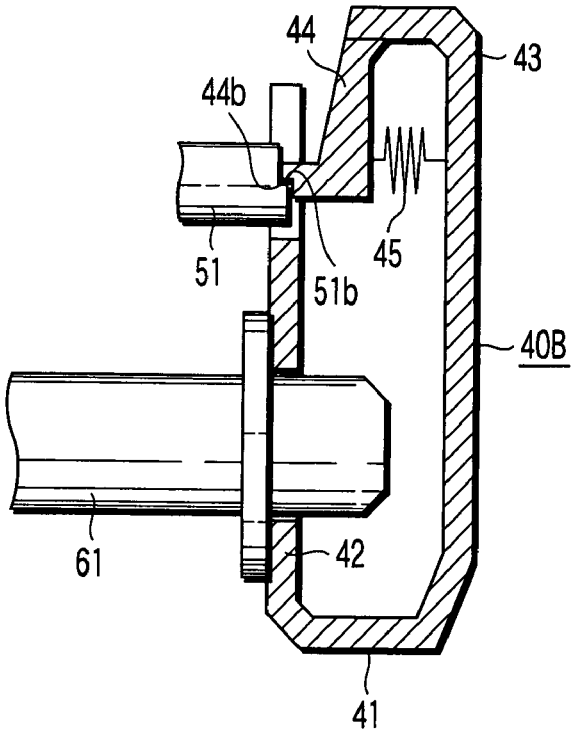
FIG. 7 is an explanatory view showing the modification of the thermal printer unit.
Figure 8:
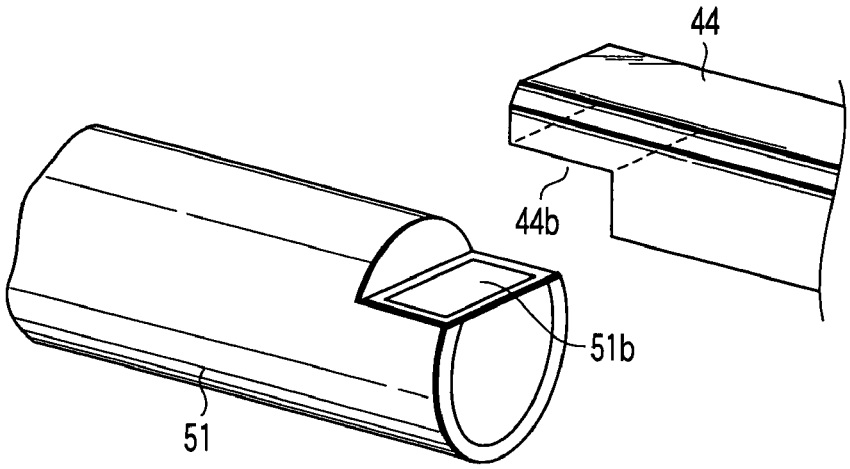
FIG. 8 is a perspective view showing a main part of the modification.

FIG. 7 is a sectional view showing a main part of a thermal printer unit 40B which is a modification of the thermal printer unit 40, and FIG. 8 is an enlarged perspective view showing a main part of the thermal printer unit 40B. In FIGS. 7 and 8, the same functional portions as those of FIG. 1 are designated by the same numbers, and the detailed description thereof will be omitted.

An engaging portion 51*b* which has a plane parallel to the axial plane including the rotating axis of the head attaching shaft 51 is provided in the thermal printer unit 40B. A latching portion 44*b* is formed in the retaining portion 44 to be brought into surface contact with the engaging portion 51*b*. The engaging portion 51*b* which is provided in the head attaching shaft 51 while having the plane parallel to the axial plane including the rotating axis of the head attaching shaft 51, the support plate 42 having the insertion hole 42*b* into which the platen roller shaft 61 is inserted, the engaging groove 42*a* which is provided above the insertion hole 42*b* of the support plate 42 to engage the head attaching shaft 51, and the retaining portion 44 having the latching portion 44*b* which is brought into surface contact with the engaging portion 51*b* provided in the head attaching shaft 51 engaged with the engaging groove 42*a* constitute the thermal head rotation preventing means and the thermal head vertical movement preventing means. Therefore, the rotational movement, the vertical movement, and the movement in the paper conveyance direction of the head attaching shaft 51 can be prevented with respect to the retaining portion 44.

When the latching portion 44*b* of the retaining portion 44 is brought into surface contact with the engaging portion 51*b* of the head attaching shaft 51, the front end 44*a* and the engaging portion 51*b* engage with each other in the vertical direction of FIG. 7. Because the fixed latching portion 44*b* is in rectangular surface contact with the engaging portion 51*b*, the head attaching shaft 51 is latched in the rotating direction, and the rotation of the head 53 is regulated through the head attaching shaft 51. At the same time, the head attaching shaft 51 is latched in the vertical direction of FIG. 7, and the movement of the head 53 is regulated through the head attaching shaft 51.

In the modification shown in FIGS. 7 and 8, the same effect as the thermal printer unit 40 can be obtained.

Figure 9:
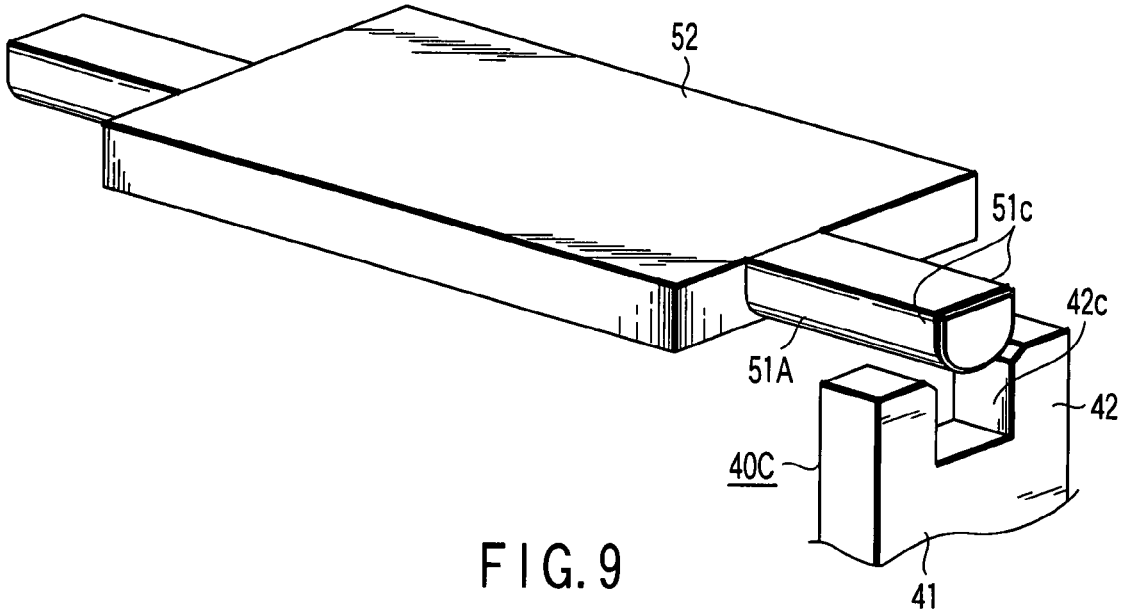
FIG. 9 is a perspective view showing a modification of the thermal printer unit.
Figure 10:
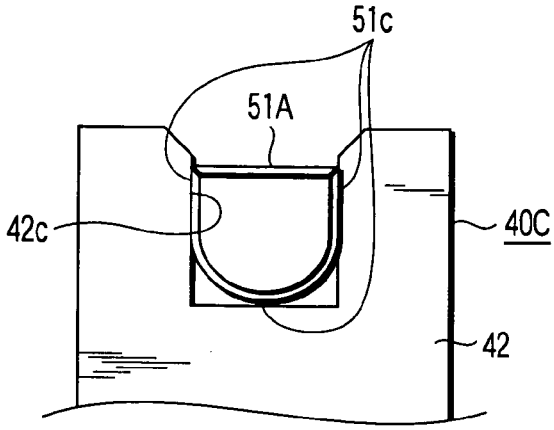
FIG. 10 is a side view showing a main part of the modification.

FIG. 9 is a perspective view schematically showing a thermal printer unit 40C which is a modification of the thermal printer unit 40, and FIG. 10 is a side view showing the thermal printer unit 40C. In FIGS. 9 and 10, the same functional portions as those of FIG. 1 are designated by the same numbers, and the detailed description thereof will be omitted.

In the thermal printer unit 40C, a head attaching shaft 51A is provided instead of the head attaching shaft 51. In the head attaching shaft 51A, the lower side is formed in a semicircular shape in section and the upper side is formed in a rectangular shape. It is assumed that an engaging surface 51*c* is a contact surface between the head attaching shaft 51A and an engaging groove 42*c* described below. Instead of the engaging groove 42*a*, an engaging groove 42*c* is provided in the support plate 42 of the support member 41 supporting the platen roller shaft 61. A maximum diameter of the head attaching shaft 51A is substantially equal to a width of the engaging groove 42*c*. Therefore, because the head attaching shaft 51A is prevented from moving in the rotating direction and in paper conveyance direction with respect to the engaging groove 42*c*, the relative position is kept between the head 53 and the platen roller portion, and the abutting position and angle are maintained between the head 53 and the platen roller 62. Accordingly, a high-quality image can be obtained in the printing.

Figure 11:
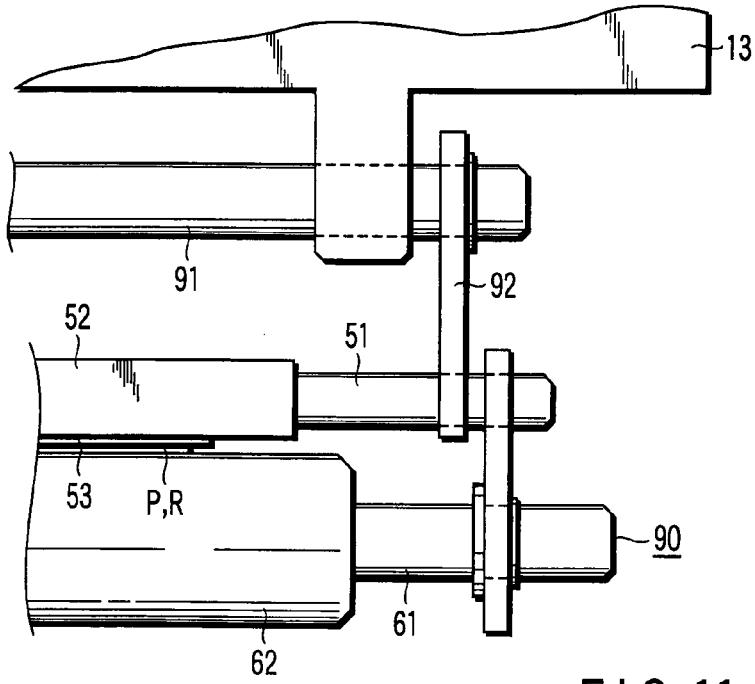
FIG. 11 is a front view showing a main part of a thermal printer into which a thermal printer unit according to a second embodiment of the invention is incorporated.
Figure 12:
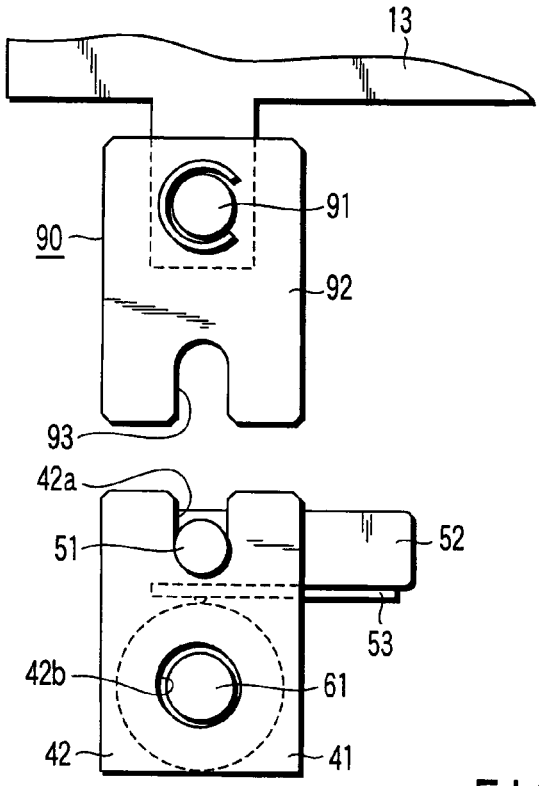
FIG. 12 is a side view showing a state in which a main part of the thermal printer unit is opened.
Figure 13:
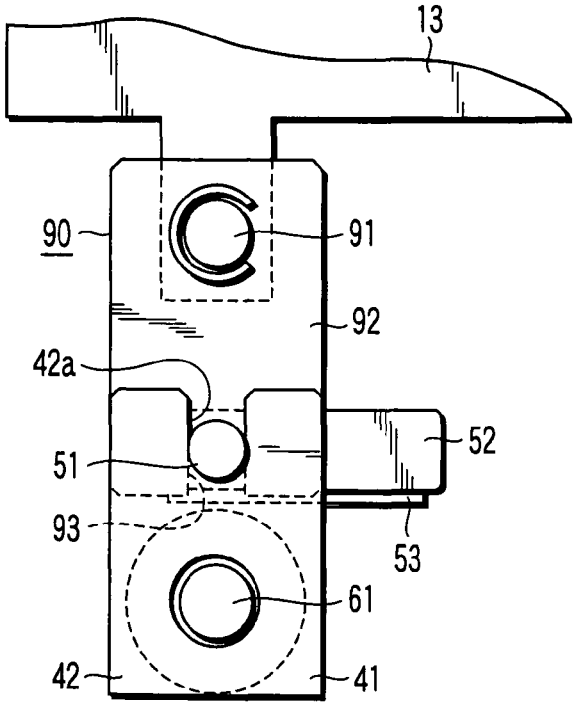
FIG. 13 is a side view showing a state in which a main part of the thermal printer unit is closed.

FIG. 11 is a front view schematically showing a main part of a thermal printer unit 90 according to a second embodiment of the invention, FIG. 12 is a side view showing a state in which the main part is opened, and FIG. 13 is a side view showing a state in which the main part is closed. In FIGS. 11 to 13, the same functional portions as those of FIG. 1 are designated by the same numbers, and the detailed description thereof will be omitted.

An attaching member 91 is provided in a lower surface of the cover 13 of the thermal printer 10 to attach an upper-side support member 92 to the cover 13. The upper-side support member 92 is attached to the attaching member 91. In FIG. 12, an engaging groove 93 opened downward is provided on the lower side of the upper-side support member 92 hung from the cover 13 through the attaching member 91. In the state in which the cover 13 is closed, the head attaching shaft 51 of the thermal head portion 50 is nipped between the engaging groove 93 of the upper-side support member 92 and the engaging groove 42*a* of the support member 42. The attaching member 91 provided in the cover 13, the engaging groove 93 which is opened downward and provided on the lower side of the upper-side support member 92 attached to the attaching member 91 in order to engage the head attaching shaft 51, the support plate 42 having the insertion hole 42*b* into which the platen roller shaft 61 is inserted, and the engaging groove 42*a* which is provided above the insertion hole 42*b* of the support plate 42 to engage the head attaching shaft 51 constitute the thermal head movement preventing means and the thermal head vertical movement preventing means. Therefore, the movement of the head attaching shaft 51 is regulated in the receptor paper conveyance direction and in the direction perpendicular to the platen roller 60.

When the head attaching shaft 51 is nipped between the engaging groove 42*a* and the engaging groove 93, the engaging groove 42*a* and the engaging groove 93 constrain the head attaching shaft 51 in the horizontal and vertical directions of FIG. 13. Accordingly, the head attaching shaft 51 is latched in the horizontal direction of FIG. 13, and the movement of the head 53 is regulated in the paper conveyance direction through the head attaching shaft 51. At the same time, the head attaching shaft 51 is also latched in the vertical direction of FIG. 13, and the movement of the head 53 is regulated through the head attaching shaft 51.

In the thermal printer 10 in which the thermal printer unit 90 is assembled, the printing is performed as follows. When a print command is inputted from the outside, the platen roller 60 is driven by the drive motor (not shown), and the receptor paper P is fed to the thermal printer unit 90. In the thermal printer unit 90, the receptor paper P and the ribbon R are nipped between the head 53 and the platen roller 62, and the heating element 54 generates heat to perform the printing to the receptor paper P.

At this point, although the force F3 shown in FIG. 14 is applied to the head 53 by the stiffness of the receptor paper P, the movement of the head attaching shaft 51 is prevented in the upward direction and in the paper conveyance direction. Therefore, because the relative position is retained between the head 53 and the platen roller portion, the abutting position and the pressure are not changed between the head 53 and the platen roller 62. Accordingly, a high-quality image can be obtained in the printing.

As described above, according to the thermal printer unit 90 of the second embodiment, a high-quality image can be obtained irrespective of the thickness and stiffness of the receptor paper P when the printing is performed to the receptor paper P.

Figure 15:
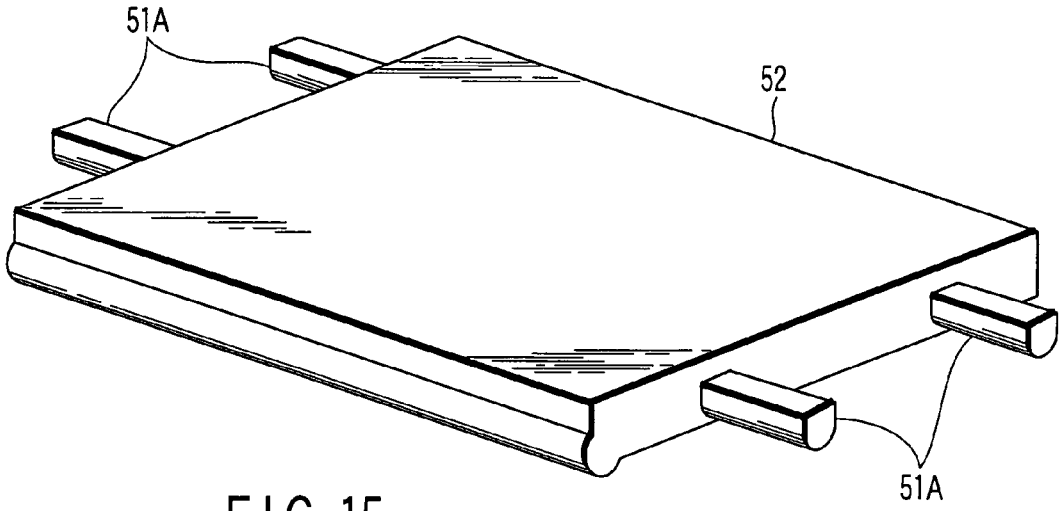
FIG. 15 is an explanatory view showing a modification of a head attaching bracket.
Figure 16A:
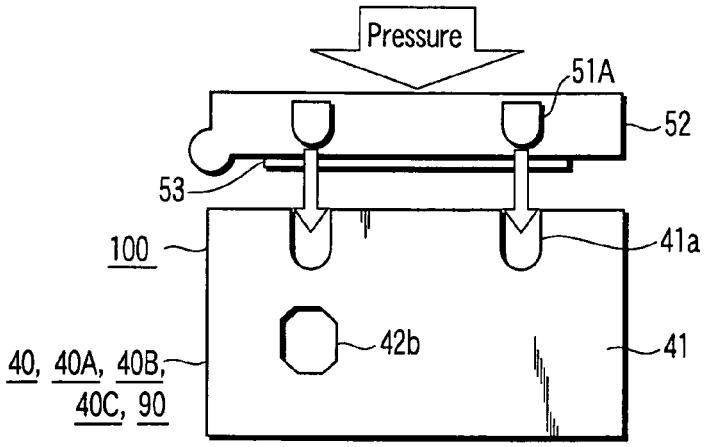
FIG. 16A is a side view showing the thermal printer unit.
Figure 16B:
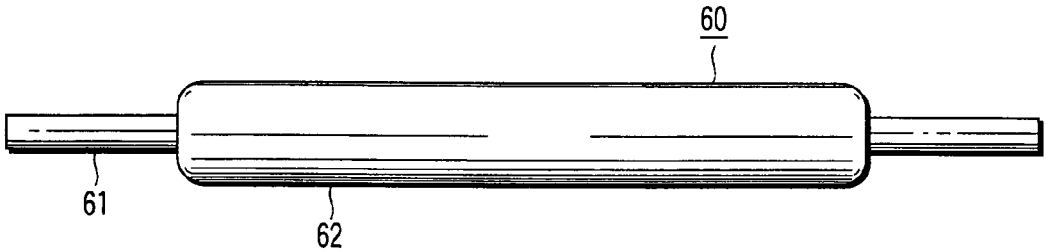
FIG. 16B is a front view showing a platen roller of the thermal printer unit.

FIG. 15 is a perspective view showing a modification of the head attaching bracket 52 which is incorporated into each of the thermal printer units 40, 40A to 40C, and 90, FIG. 16A is a side view showing the thermal printer units 40, 40A to 40C, and 90, and FIG. 16B is a front view showing the platen roller portion 60. In FIGS. 15, 16A, and 16B, the same functional portions as those of FIG. 1 are designated by the same numbers, and the detailed description thereof will be omitted.

The four head attaching shafts 51A are provided in the head attaching bracket 52. The head attaching bracket 52 is guided to the support member 41 by the pressure from above. At this point, the head attaching shafts 51A are inserted into the engaging grooves 42*a* provided in the support member 41. The head attaching bracket 52 is thus fixed while supported at four points, so that the movement in the paper conveyance direction, the rotation, and the movement in the distortion direction can be prevented in the head attaching bracket 52. Additionally, the insertion hole 42*b* into which the platen roller shaft 61 is inserted is provided in the support member 41. The relative position with the insertion hole 42*b* of the support member 41 is set such that the relative position between the head 53 and the platen roller portion becomes optimum. That is, the abutting position and the angle are determined between the head 53 and the platen roller 62 such that the relative position between the head 53 and the platen roller portion becomes optimum. The four-point support fixing can achieve the higher quality image.

The invention is not limited to the above embodiments, but obviously various changes and modifications can be made without departing from the scope of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal printer unit comprising:

a thermal head attached to a thermal head portion having a first engaging portion with a pair of parallel opposing surfaces;

a platen roller facing the thermal head and spaced apart from the thermal head to define a nip through which a recording medium is conveyed during printing;

a support for the platen roller, the support having a second engaging portion that is configured for engagement with the first engaging portion, the second engaging portion having a generally rectangular tip with side surfaces that contact the parallel opposing surfaces of the first engaging portion when the first engaging portion and the second engaging portion are engaged during printing to prevent the thermal head from moving in a recording medium conveyance direction and in a rotating direction.

2. The thermal printer unit according to claim 1, wherein the support has a shaft insertion hole into which a shaft for the platen roller is inserted.

3. The thermal printer unit according to claim 1, wherein the first engaging portion is a kerf hole and the second engaging portion is a latching portion that is configured to be fitted in the kerf hole.

4. The thermal printer unit according to claim 1, wherein the first engaging portion and the second engaging portion extend in a direction that is perpendicular to the recording medium conveyance direction.

5. The thermal printer unit according to claim 1, wherein the support includes a pair of support members disposed on opposite ends of the thermal head portion and the platen roller.

6. The thermal printer unit according to claim 1, wherein the rotating of the thermal head that is prevented is in a direction that is opposite the rotating direction of the platen roller.

7. A thermal printer unit comprising:

a thermal head and a platen roller between which a recording medium is conveyed during printing;

a first support for the thermal head having a first engaging portion with a pair of rectangular corner surfaces; and a second support for the platen roller having a second engaging portion with a pair of rectangular corners that contact the rectangular corner surfaces of the first support when the first engaging portion and the second engaging portion are engaged during printing to prevent the thermal head from moving in a recording medium conveyance direction and in a rotating direction.

8. The thermal printer unit according to claim 7, wherein the second support has a shaft insertion hole into which a shaft for the platen roller is inserted.

9. The thermal printer unit according to claim 7, wherein the first engaging portion is a kerf hole and the second engaging portion is a latching portion that is configured to be fitted in the kerf hole.

10. The thermal printer unit according to claim 7, wherein the first engaging portion and the second engaging portion extend in a direction that is perpendicular to the recording medium conveyance direction.

11. The thermal printer unit according to claim 7, wherein the first support has a pair of first engaging portions, one on each end of the thermal head, and the second support has a pair of second engaging portions, one on each end of the platen roller.

12. The thermal printer unit according to claim 7, wherein the rotating of the thermal head that is prevented is in a direction that is opposite the rotating direction of the platen roller.

* * * * *